United States Patent [19]

Tani et al.

[11] Patent Number: 4,967,234

[45] Date of Patent: Oct. 30, 1990

[54] IMAGE FORMING APPARATUS

[75] Inventors: Tatsuo Tani, Urayasu; Mutsuo Watanabe; Shigeru Muramatsu, both of Yokohama, all of Japan

[73] Assignee: Ricoh Company, Ltd., Tokyo, Japan

[21] Appl. No.: 268,866

[22] Filed: Nov. 8, 1988

[51] Int. Cl.[5] ..... B03G 15/06

[52] U.S. Cl. ..... 355/260

[58] Field of Search ..... 355/200, 205, 206, 209, 355/245, 246, 260

[56] References Cited

U.S. PATENT DOCUMENTS

| | | | |
|---|---|---|---|
| 4,174,902 | 11/1979 | Hamaguchi | 355/246 |
| 4,523,834 | 6/1985 | Pelda et al. | 355/260 |
| 4,607,939 | 8/1986 | Saito | 355/200 |

*Primary Examiner*—Michael L. Gellner
*Assistant Examiner*—Khanh Dang
*Attorney, Agent, or Firm*—Oblon, Spivak, McClelland, Maier & Neustadt

[57] ABSTRACT

A copier, printer or similar image forming apparatus operable with a supply such as a developer cartridge being loaded in a body thereof. A door forms a part of a housing portion of the apparatus body and is provided with an opening for loading and unloading a supply and an openable lid for covering and uncovering the opening. Even when the lid is opened, the operation of the apparatus is not interrupted. Simple and safe replacement of a supply is insured and, yet, a supply is prevented from contaminating the apparatus when loaded and unloaded.

5 Claims, 10 Drawing Sheets

IMAGE FORMING APPARATUS

BACKGROUND OF THE INVENTION

The present invention relates to an image forming apparatus operable with a disposable supply being loaded in a body thereof.

It is a common practice with a copier, facsimile apparatus, printer or similar image forming apparatus to load various disposable supplies in a body of the apparatus. For example, an image forming apparatus of the type using a developing unit for developing an electrostatic latent image formed on a photoconductive element or similar image carrier by a developer is operable with a developer cartridge. The developer cartridge is loaded in the body of the apparatus for supplying a developer and is a typical disposable supply. Another typical supply is a silicone oil tank which may also be loaded in the apparatus. Such various supplies are individually replaced with new ones as needed. It has been customary to replace desired one of the supplies by opening a large front door which is mounted on the apparatus body. This is undesirable from the safety standpoint because when the front door is opened, various movable parts such as paper feed rollers and timing belts and various electrical parts such as motors and solenoids are uncovered.

An implementation heretofore proposed against the above hazard is an interlocking device which automatically interrupts the operation of the apparatus, i.e., mechanical motions and current supply when the front door is opened for the replacement of a supply. However, interrupting the operation of the apparatus every time a supply is replaced lowers the productivity (number of papers produced with images per unit time). Thus, prior art image forming apparatuses are incapable of continuing the image forming operation while insuring safety manipulations for the replacement of a supply, i.e., achieving satisfactory productivity. Further, since various knobs and other numerous parts such as for the removal of a jamming sheet are densely arranged inside of the front door, a person intending to replace a particular supply is often perplexed resulting in the operation efficiency being lowered.

In a prior art copier or similar image forming apparatus which develops an electrostatic latent image provided on an image carrier by using a developer in the form of powder, the operation is automatically stopped when the developer almost runs out or when a predetermined number of further copies are produced after such a near-end condition has been reached. When the developer is implemented by a two-component developer which is the mixture of toner and carrier, the copying operation is inhibited until the toner supplied to the apparatus or the toner cocnentration in the developer exceeds a predetermined amount. A drawback with this kind of control is that the downed condition of the copier continues until the supply of toner, preventing a person from producing urgent copies or forcing a person to give up copying when only a few more copies suffice. This limits the productivity of copies (number of copies per unit time).

This kind of developing unit may be operated with a developer cartridge which is an example of supplies as stated earlier. In the case that such a developing unit is so constructed as to allow a developer cartridge into and out of its body through an opening which is formed through a housing portion, there is a fear that the operator's hand is carelessly put into a cartridge inserting and removing path via the opening while the used cartridge is removed. Touching various movable members arranged around the path is very dangerous. It is therefore impossible to adopt a system which allows a developer cartridge to be replaced without interrupting the operation of the apparatus, unless such hazards are removed.

A developing unit of the type described includes an agitator or similar agitating member for preventing the developer stored in a developer supply chamber or in the apparatus body itself from blocking. When a developer cartridge is used with such a developing unit and loaded and unloaded through the opening which is formed through the housing portion of the apparatus body as previously stated, the agitating member which is rotating is hazardous for the operator who may inadvertently insert the hand into the cartridge inserting and removing path via the opening. Preferably, therefore, the agitating member should be disenabled throughout the inteval between the removal of the used cartridge and the insertion of a new cartridge. Suspending the agitating operation for such an interval is not critical because it will be resumed as soon as a new cartridge is loaded. Even during the above-mentioned interval, the copier should preferably be operated without interruption.

In the case of a two-component developer, toner is sequentially supplied to the developer as the toner concentration in the developer is decreased. The supply of toner is essential even in the case of a one-component toner. In an image forming apparatus of the type using a toner cartridge for the supply of toner and replacing the cartridge through an opening which is formed through a housing portion of the apparatus, toner adhered to the bottom wall of the used cartridge is apt to be scattered around or dropped through the opening due to vibrations when the cartridge is removed from the apparatus. Such toner would contaminate the exterior of the apparatus.

SUMMARY OF THE INVENTION

It is therefore an object of the present invention to provide an image forming apparatus which allows a supply to be replaced with ease and safety without interrupting its operation.

It is another object of the present invention to provide an image forming apparatus which allows a developer to be supplied while continuing its operation and, yet, protects the operator from injuries even when the operator's hand is carelessly inserted into a cartridge inserting and removing path which is formed through a housing portion of the apparatus body.

It is another object of the present invention to provide an image forming apparatus which is free from contamination otherwise caused in the event of replacement of a developer cartridge.

It is another object of the present invention to provide a generally improved image forming apparatus.

An image forming apparatus of the present invention comprises a body having a housing portion, an opening formed through the housing portion for inserting and removing a supply from the body, and an openable lid associated with the opening for covering and uncovering the opening, whereby an image forming operation of the apparatus is not interrupted even when the lid is opened to uncover the opening.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
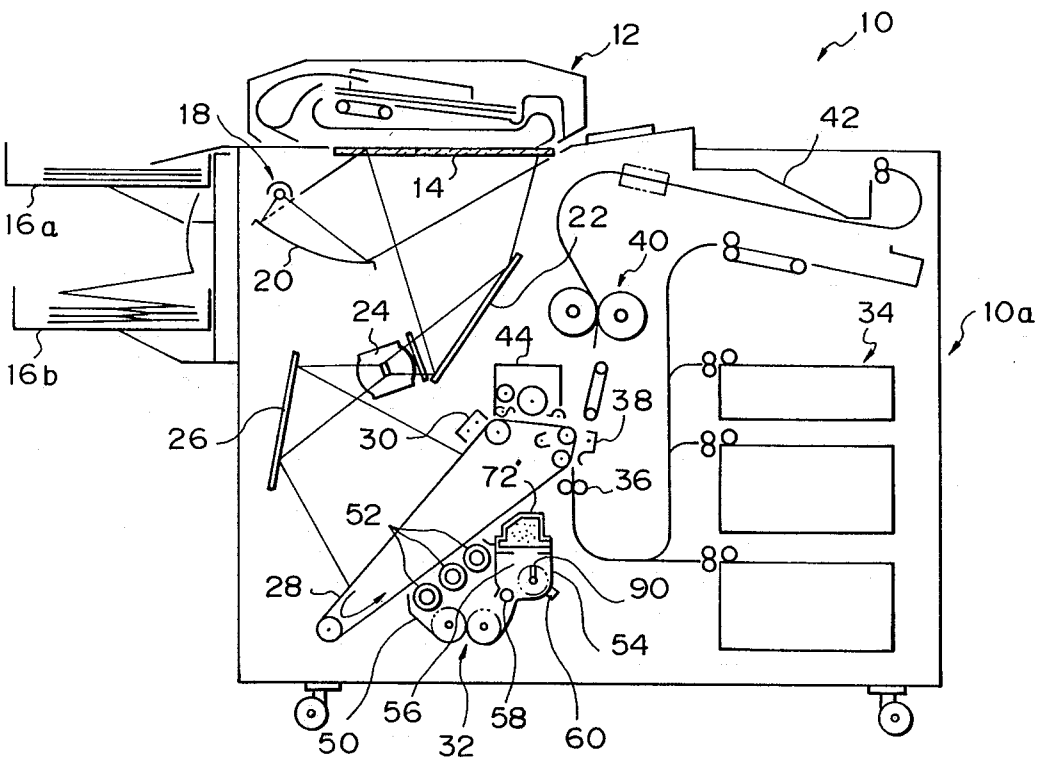
FIG. 1 is a schematic view showing a copier embodying the present invention.

Referring to FIG. 1 of the drawings, an image forming apparatus embodying the present invention is shown in the form of an electrophtographic copier. While the present invention is applicable not only to a two-component developer made up of carrier and toner but also to a one-component developer which lacks carrier, the following description will concentration on a two-component developer by way of example.

Figure 2:
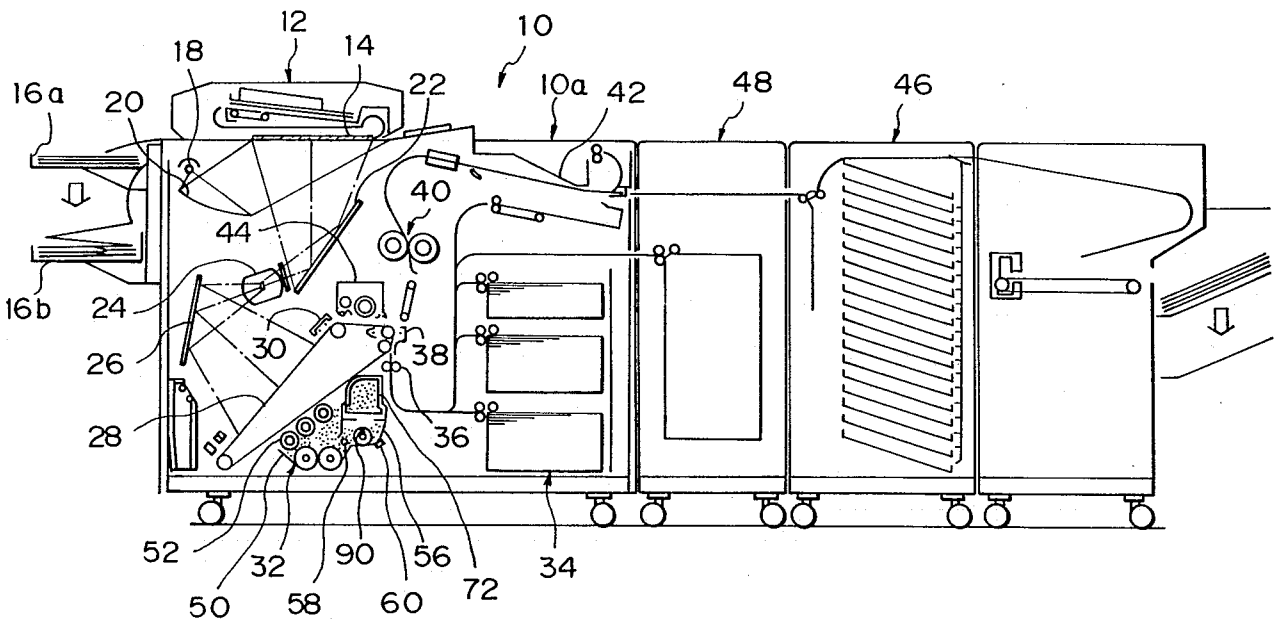
FIG. 2 is a view schematically showing the copier of FIG. 1 to which a sorter is operatively connected.

In the figure, the copier, generally 10, includes a body 10*a* and an ADF (Automatic Document Feeder) 12 mounted on the top of the copier body 10*a*. Documents in the form of sheets or a paper outputted by a computer are sequentially fed from the ADF 12 to a glass platen 14 and then either returned to the ADF 12 or discharged to a tray 16*a* or 16*b*. A light source 18 instantly illuminates the entire surface of the document reached the glass platen 14 by way of a mirror 20. An imagewise reflection from the document is focused onto a photoconductive element 28 via a mirror 22, a lens 24 and a mirror 26. The photoconductive element 28 serves as an image carrier and is shown as comprising a belt. The belt 28 is driven in a direction indicated by an arrow and uniformly charged beforehand by a main charger 30. The imagewise reflection from the document is focused on the charged belt 28 to form an electrostatic latent image thereon. The latent image is developed by a developing unit 32 to become a toner image and then transferred to a paper sheet which is fed from a sheet feed section 34 via a register roller pair 36, the image transfer being effected by corona discharge of a transfer charger 38. After such image transfer, the paper sheet is routed through a fixing unit 40 to a tray 42 which is located in an upper portion of the copier body 10*a*. On the other hand, the surface of the belt 28 is cleaned by a cleaning unit 44 so that toner and other particles remaining on the belt 28 are removed. As shown in FIG. 2, a sorter 46 and/or a mass paper feeder 48 may be operatively connected to the copier body 10*a* so as to transfer the paper sheet coming out of the fixing unit 40 to the sorter 48.

The developing unit 32 includes a developer container 50 which is filled with a developer which is the mixture of toner and carrier. The developer is fed to developing rollers 52 and only the toner is applied to the belt 28 to develop the latent image. As the development is repeated, the toner in the developer container 50 is sequentially consumed resulting in the toner concentration in the developer being sequentially reduced. The developing unit 32 is provided with a toner supply chamber 56 which is physically isolated from a tone hopper 54. A toner supply roller 58 is disposed in the toner supply chamber 56 and rotatable to feed a supplementary amount of toner to the developer container 50. The concentration of toner in the developer is sensed by a toner concentration sensor (not shown) which is disposed in the developer container 50. The amount of toner remaining in the toner supply chamber 56 sequentially decreases due to the consumption of toner as mentioned above. Developer near-end sensing means in the form of a toner near-end sensor 60 is located in a bottom portion of the toner supply chamber 56 to sense a decrease in the amount of toner remaining in the supply chamber 56 to blow a predetermined amount. In practice, the toner near-end sensor 60 may be implemented by a piezoelectric sensor of a light-transmitting sensor.

When such a toner near-end condition is sensed, a message such as "SUPPLY TONER" appears on a display panel 62 (see FIG. 3) for urging a person to supply toner. The display panel 62 is located in an upper front part of the copier body 10*a*. If no toner is supplied despite such a message, a toner end signal is produced when a predetermined number of further copies (e.g. 3,000 copies) have been produced. Then, such a condition is displayed and the machine is stopped (see FIG. 10). Stated another way, even if toner is not supplied immediately after the appearance of a toner near-end signal, it is possible to further produce a predetermined number of copies with the remaining toner. Alternatively, an arrangement may be made such that the toner end signal appears when the copying operation is repeated without supplying toner and the lowered toner concentration is not restored. In any case, the copying operation can be repeated without supplying toner after the appearance of the toner near-end signal.

Figure 3:
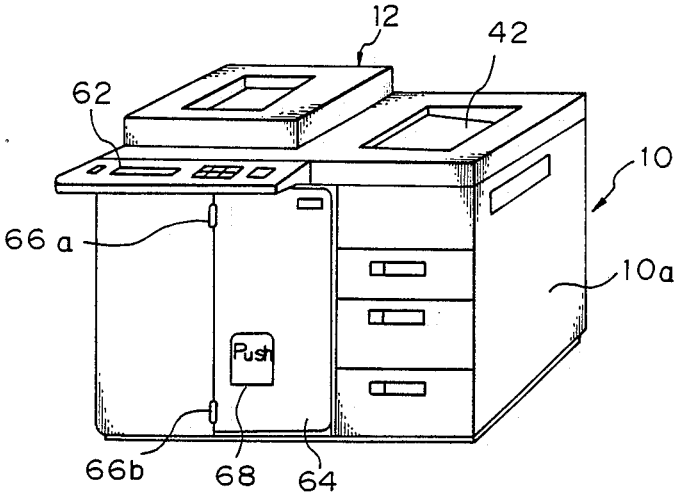
FIG. 3 is an external perspective view of the copier shown in FIG. 1.
Figure 8:
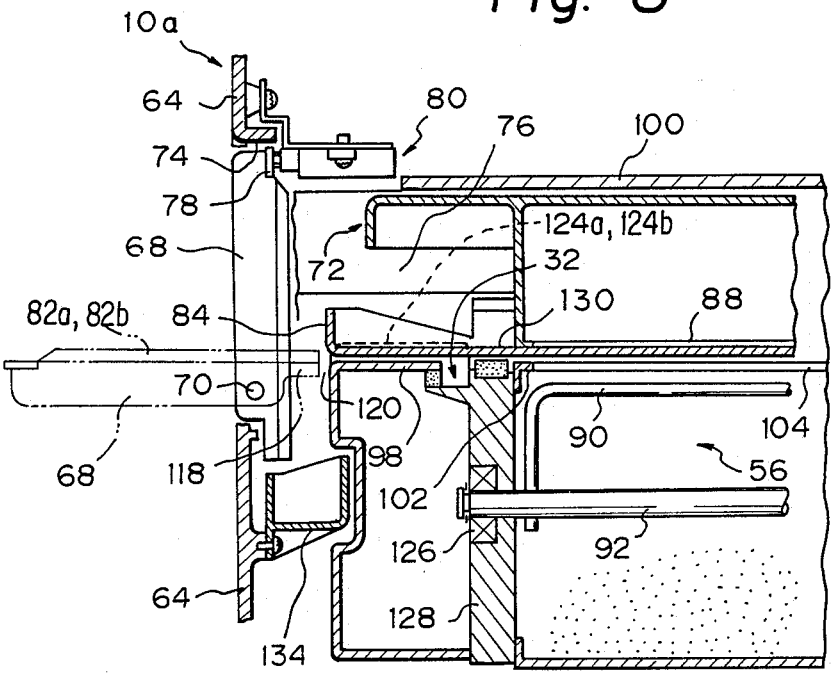
FIG. 8 is a section showing various members which are arranged around the cartridge inlet section.

Referring to FIG. 3, the copier 10 is shown in an external view. A front door 64 forms a part of the front wall of the copier body 10*a* and is rotatable about hinges 66*a* and 66*b* to an open position. The front door 64 is provided with an openable lid 68. The front door 64 may be opened for removing a jamming sheet and other purposes. A lug (not shown) extends from the inner surface of the front door 64 while an interlock switch is provided in that part of the copier body 10*a* which faces the lug when the door 64 is closed. When the front door 64 is open, the interlock switch is turned off to interrupt the copying operation of the copier 10. Conversely, when the front door 64 is closed, the interlock switch is turned on to allow the copier 10 to resume its operation. In this manner, in the illustrative embodiment, the lug of the front door 64 and the interlock switch cooperate to free a person from hazards otherwise brought about when the door 64 is opened. As shown in FIG. 8, the lid 68 is rotatably mounted at its lower end on a shaft 70 and, therefore, swingable up and down about the shaft 70.

Figure 7:
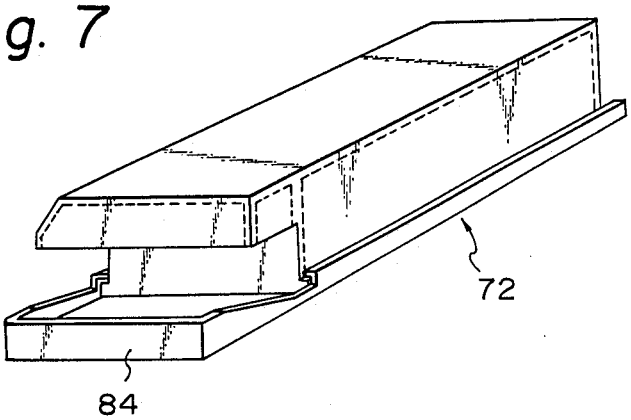
FIG. 7 is a view of the toner cartridge.

FIG. 7 shows a toner cartridge 72 which is filled with toner to be supplied. The toner cartridge 72 is shown in a mounted position in FIGS. 5 and 8.

Figure 4:
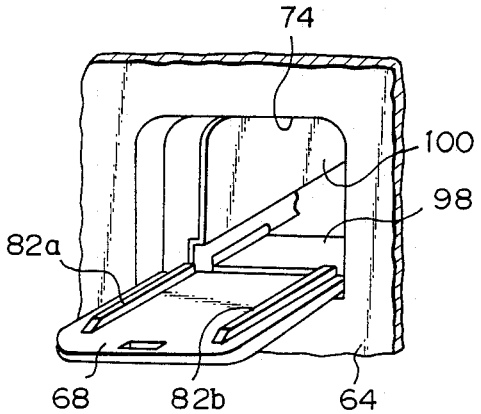
FIG. 4 is a fragmentary perspective view showing a cartridge inlet section of the copier which is covered and uncovered by a lid which is mounted on a front door of the copier.

As shown in FIG. 4, the front door 64 is formed with an opening 74 for mounting and dismounting the toner cartridge 72. As shown in FIG. 8, a path 76 for the insertion and removal of the toner cartridge 72 is defined above the toner supply chamber 56 and contiguous with the opening 74 of the front door 64. The lid 68 is adapted to cover and uncover the opening 74 which is contiguous with the path 76. A magnetic member 78 is fitted on the free or upper end of the lid 68 while a so-called push-push type magnet catch 80 is fitted on the copier body 10*a* for attracting the magnetic member 78, so that the lid 68 may be selectively held in its closed position and released from the same. For example, the lid 68 is caused into an open position when pushed once and into a closed position when pressed again. To replace the toner cartridge 72, the lid 68 is rotated from a vertical position indicated by a solid line in FIG. 8 to a horizontal position indicated by a dash-and-dots line so as to uncover the opening 74.

In response to an output of the toner near-end sensor 60 (FIG. 1) representative of a toner near-end condition, a message "SUPPLY TONER" appears on the display panel as stated earlier. Noticing this message, a person using the copier 10 or a serviceman replaces the toner cartridge 72 by pressing the lid 68 and thereby opening the lid 68 to the horizontal position. Stated another way, the operator can replace the toner cartridge 72 without opening the front cover 64. More specifically, after the lid 68 has been opened, the used toner cartridge 72 is bodily pulled to the left as viewed in FIG. 8 out of the path 76 of the copier body 10*a*. While the toner cartridge 72 is removed so, the copying operation of the copier 10 is of course continued. This is because the lid 68 is not provided with any interlocking device and therefore can be opened without interrupting the image forming operation.

After the removal of the used toner cartridge 72, a fresh toner cartridge is inserted into the path 76 of the copier body 10*a* through the opening 74 while being guided by the lid 68 which is held in the open or horizontal position. More specifically, a pair of elongate lugs or guides 82*a* and 82*b* (FIG. 4) are provided on that surface of the lid 68 which faces the path 74 when the lid 68 is closed, the toner cartridge 72 being inserted along the guides 82*a* and 82*b*. The guides 82*a* and 82*b* also guide the toner cartridge 72 when the latter is pulled out of the copier body 10*a*. This is why the lid 68 is swingable about its lower end.

The toner cartridge 72 is provided with a slidable lid 84 at its bottom. After a fresh toner cartridge 72 has been mounted in the position shown in FIG. 8, the lid 84 of the cartridge 72 is pulled out with the body of the cartridge 72 being left in the copier body 10*a*. Then, the lid 84 automatically removes a seal 86 (FIG. 4) from the bottom of the cartridge 72 to uncover an opening 88 which is formed through the bottom of the cartridge 72. As a result, toner in the toner cartridge 72 is dropped into the toner supply chamber 56 and this supplementary amount of toner allows the copying operation to be continued over a long time. After the toner has been fully dropped from the toner cartridge 72 into the toner supply chamber 56, the lid 84 is slid again into the original position and then the lid 68 of the front door 64 is closed.

As described above, the toner cartridge 72 can be replaced simply by opening the lid 68 which does not have an interlocking device, i.e., without opening the door cover 64 which has an interlocking device. The replacement therefore can be accomplished without interrupting the operation of the copier 10, enhancing efficient copying operations. Since the door 64 is kept closed during the replacement, it substantially prevents various structural parts and elements installed in the copier body 10*a* from showing themselves and thereby guarantees safety operations. Moreover, the operator is prevented from being perplexed during the manipulations because the various parts and elements inside the door 64 are not visible.

While the opening 74 and the lid 68 for covering and uncovering the opening 74 may be provided in any other part of the housing portion of the copier body 10*a* such as a fixed wall, providing them in the front door 64 is more advantageous for the following reason. Specifically, when the front door 64 is opened, the toner cartridge 72 shows itself to the outside and is therefore accessible for replacement. Hence, the toner cartridge 72 may also be replaced when the front door 64 is opened for the inspection or maintenance of the interior of the copier body 10*a*.

Figure 9:
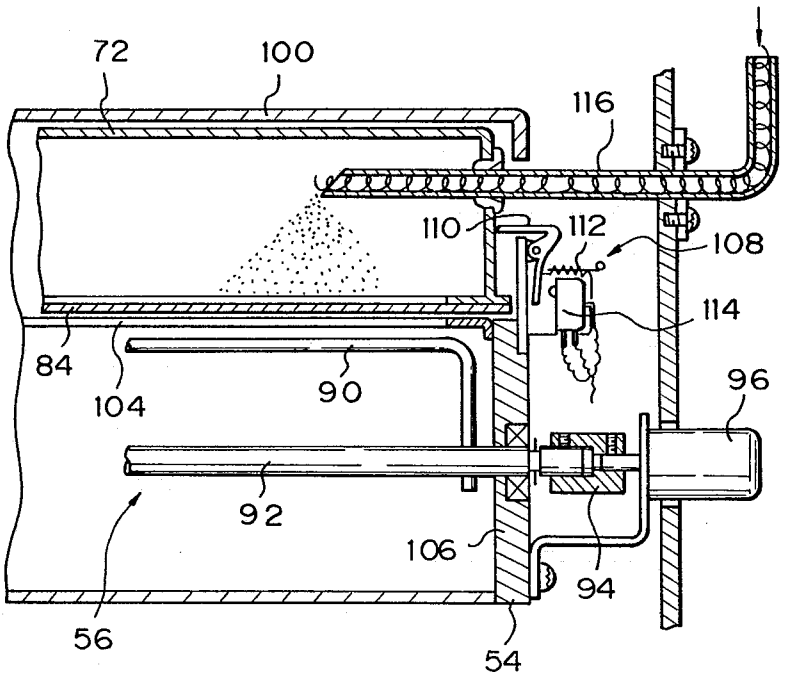
FIG. 9 is a section showing various members which are arranged around in a portion which is remote from the inlet section.

As shown in FIGS. 8 and 9, a toner agitating device including a shaft 92 and an agitating member 90 is disposed in the toner supply chamber 56 of the developing unit 32. A motor 96 is connected to the shaft 92 by a coupling 94. The motor 96 drives the shaft 92 and therefore the agitating member 90 in a rotary motion, whereby toner in the toner supply chamber 56 is agitated so as not to cause blocking. If the operator's hand is inadvertently inserted into the path 76 through the opening 74 after the used toner cartridge 72 has been removed from the path 76 and if the machine 10 is in operation, the agitating member 90 and other movable members operating around the path 76 are apt to injur the operator. The operator may even tough the belt 28, register roller pair 36 and the like being operated and be injured thereby while in turn damaging the belt 28. Further, the operator should be kept away from various leads, motors, solenoids, connector terminals and other electrical parts and elements which are also disposed around the path 76. Replacing the toner cartridge 72 without interrupting the copying operation is impracticable unless such a dangerous situation is removed.

In the light of the above, the illustrative embodiment further includes protection members for preventing the operator's hand from reaching the neighborhood of the path 76 during the insertion of a toner cartridge. Specifically, as shown in FIG. 8, an inner cover 98 is disposed at the bottom of the inlet portion of the path 76. The inner cover 98 prevents the operator from touching that end of the shaft 92 which is shown in FIG. 8. The shaft 92 is driven by the motor 96 (FIG. 9) while carrying the agitating member 90 therewith. Another function of the inner cover 98 is guiding the toner cartridge 72 while the latter is loaded and unloaded. When the toner cartridge 72 is to be replaced with the front door 64 being opened for removing a jamming sheet or similar purpose, it will be directly laid on the inner cover 98 and then pushed deeper into the path 76.

Figure 5:
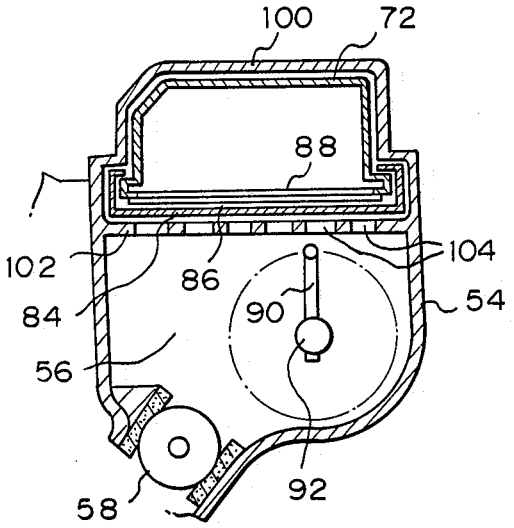
FIG. 5 is a section of a toner hopper section of a developing unit which is included in the copier.

A cartridge cover member 100 surrounds the path 76 to serve as another protective member. As shown in FIG. 5, the catridge cover member 100 is formed integrally with the toner hopper 54 which defines the toner supply chamber 56. A partition 102 is provided at the lower end of the cartridge cover member 100 and formed with slots 104 for the supply of toner, the slots 104 individually parallel to the shaft 92. The partition 102 prevents the operator from inserting the fingers into the toner supply chamber 56 where the shaft 92 and agitating member 90 are positioned. Stated another way, the slots 104 are so dimensioned as not to allow the fingers thereinto. The cartridge cover member 100 serves as a guide for the toner cartridge 72 and, at the same time, keeps the operator's hand away from the neighborhood of the path 76, i.e., from the movable parts and electrical parts which are arranged around the path 76. This insures safety manipulations even when the lid 68 is open while allowing the copying operation to be continued without any trouble. Hence, the toner cartridge 72 can be replaced without interrupting the operation of the copier 10 to thereby reduce the down time of the copier 10.

Figure 6:
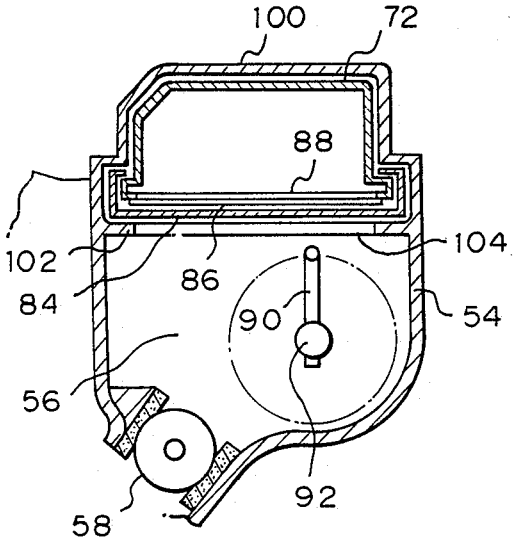
FIG. 6 is a view of the toner hopper section which is partly different from the toner hopper section of FIG. 5.

As shown in FIG. 6, the slots 104 formed through the wall 102 may be enlarged so as to promote efficient drop of toner into the toner cartridge 72. However, such a configuration is problematic from the safety standpoint because the operator's finger may accidentally enter the toner supply chamber 56 through the wide opening 104 when the operator puts the hand into the path 76.

In the illustrative embodiment, in order that safety may be insured even with the configuration shown in FIG. 6, a cartridge sensor 108 responsive to the toner cartridge 72 is mounted in an upper end portion of one side wall 106 of the toner hopper 54, as shown in FIG. 9. The cartridge sensor 108 includes an actuator 110, a spring 112 for constantly biasing the actuator 110, and a switch 114. When the toner cartridge 72 is held in a toner supply position as shown in FIG. 9, it presses the actuator 110 against the action of the spring 112. In this condition, the switch 114 does not perform any switching actin so that the motor 96 is continuously energized to rotate the agitating member 90. When the cartridge 72 is pulled out from the path 76, the actuator 110 is rotated by the spring 112 to actuator the switch 114 with the result that the motor 96 is deenergized to in turn stop the rotation of the agitating member 90 (see FIG. 11). Although the agitating member 90 becomes inoperative as mentioned, the copying operation of the copier 10 is continued without any interruption. So long as the toner agitating device is inoperable, the operator's hand is protected even if accidentally inserted into the path 76. This further enhances safety manipulations during the replacement of the toner cartridge 72 and, in addition, makes it needless to interrupt the operation of the machine.

When a fresh toner cartridge 72 is loaded in the path 76 after the removal of the used cartridge 72, the cartridge sensor 108 senses it to energize the motor 96 so that the agitating member 90 is caused into rotation again. Although the agitating member 90 is maintained inoperable during the interval between the removal of the old toner cartridge 72 and the insertion of the new cartridge 72, such an interval is negligibly short in practice. If desired, an output of the cartridge sensor 108 representative of the absence of a toner cartridge may be displayed on the display panel or the like or urge the operator to load a new toner cartridge (FIG. 11).

Figure 11:
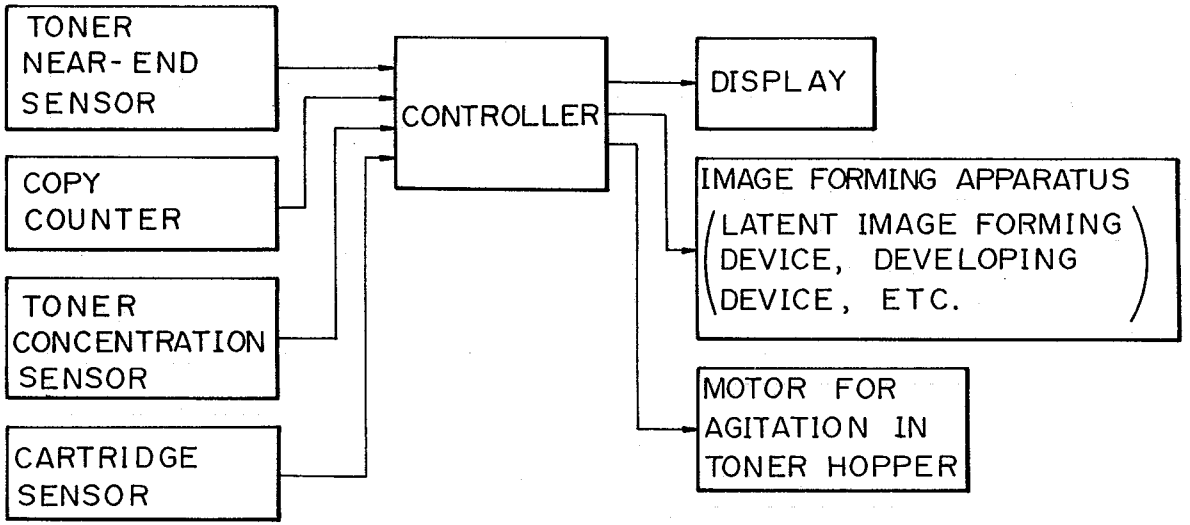
FIG. 11 is a schematic block diagram showing a control system installed in the copier.

The surface of the belt 28 shown in FIG. 11 is cleaned by the cleaning unit 44 to remove toner particles remaining thereon. An arrangement may be so made as to collect the removed toner particles into the toner cartridge 72 which has been emptied, thereby eliminating the need for an exclusive container for collection. As shown in FIG. 9, when a new toner cartridge 72 is loaded in the copier body 10*a*, a leading end portion of a toner discharge conduit 116 enters the toner cartridge 72. In this condition, pulling out the slidable lid 84 of the toner cartridge 72 causes the toner to drop from the cartridge 72 until the cartridge 72 becomes empty. After the lid 84 has been closed again, waste toner collected by the cleaning unit 44 is transported through the toner discharge conduit 116 at suitable timings. As a result, such toner is collected in the toner cartridge 72. Should this part of toner be collected without using the toner cartridge 72, it would be mixed with fresh toner in the toner supply chamber 56 to bring about contamination of the background and scattering of toner from the developing unit.

Displaying the absence of a toner cartridge 72 in the path 76 as stated earlier is also useful to prevent the operator from introducing the waste toner into the toner supply chamber 56. If desired, such a display may be accompanied by an alert tone. When the copying operation is continued for a predetermined period of time or repeated a predetermined number of times before the insertion of the toner cartridge 72, the copier 10 should advantageously be deactivated and so controlled as to prevent waste toner from reaching the toner discharge conduit 116. This inhibits a large amount of waste toner from entering the toner supply chamber 56.

The inner cover 98 loaded at the bottom of the path 76 also plays the role of a guide for guiding the toner cartridge 72, as stated earlier. As shown in FIG. 8, when the lid 68 is held in the horizontal or open position, the inner cover 98 becomes flush with the lid 68 at a spacing 120 from the inner end 118 of the latter. In this condition, the toner cartridge 72 is guided by the lugs 82*a* and 82*b* of the lid 68 and a pair of elongate lugs or guides 124*a* and 124*b*", which are provided on the upper surface of the inner cover 98. In this instance, the bottom lid 84 of the toner cartridge 72 shown in FIG. 8 is apt to gather toner particles and therefore to allow them to be scattered around when the toner cartridge 72 is pulled out. To eliminate such an occurrence, a scraping member 130 made of sponge or similar material is fixed to the upper end of a hopper side wall 128 which supports one end of the shaft 92 rotatably through a bearing 126. When the cartrige 72 is pulled out together with the lid 84, toner particles adhered to the bottom of the lid 84 are scraped off by the scraping member 130. The toner particles which may jump off the bottom of the lid 84 are collected in a channel 132 which is located in the vicinity of the scraping member 130 and not clearly visible from the outside.

In the above configuration, toner particles will in due course accumulate in the channel 132 or they are apt to be scattered around from the position where the scraping member 130 is located toward the inner cover 98. Once such toner particles adhere to the inner cover 98, they are apt to be scattered around to the outside from the inner cover 98 when the toner cartridge 72 is removed from the copier body 10*a*, contaiminating the exterior of the machine. In the illustrative embodiment, a box-like toner collector 134 is fixed in place below the previously mentioned spacing 120. As the toner cartridge 72 is pulled out of the copier body 10*a*, its bottom sequentially scrapes the top of the inner cover 98 so that toner particles intervening between the toner cartidge 72 and the inner cover 98 are sequentially dropped into the toner collector 134 through the spacing 120. This part of the toner therefore is prevented from being scattered around and contaminating the outside of the machine.

While the toner cartridge 72 is moved toward the outside of the copier body 10*a*, there is also a fear that toner particles on the bottom of the cartridge 72 are dropped onto the lid 68 which is associated with the front door 64. Such a fear may be eliminated by extending the toner collector 134 as far as an imaginary downward extension of the lid 68 in the upright position of the lid 68. In this configuration, when the lid 68 is closed or when the toner cartridge 72 scrapes the guides of the lid 68, toner adhered to the lid 68 or its guides will be dropped into the toner collector 134. Further, providing the front door 64 with the lid 68 and toner collector 134 is advantageous in that when the door 64 is opened and closed for removing a jamming sheet, for example, the resulting vibrations facilitates the drop of toner from the lid 68. Especially, when the front cover 64 is caused to vibrate noticeably due to the contact of the operator's leg or similar occurence, toner on the lid 68 will be positively dropped into the toner collector 134. Should the toner collector 134 be absent, such toner dropping from the lid 68 would smear the floor or the like. If desired, the toner collector 120 may be associated with the developing unit, for example, so as to receive toner dropping through the spacing 120 and, when the front door 64 is closed, toner dropping from the upright lid 68.

Figure 10:
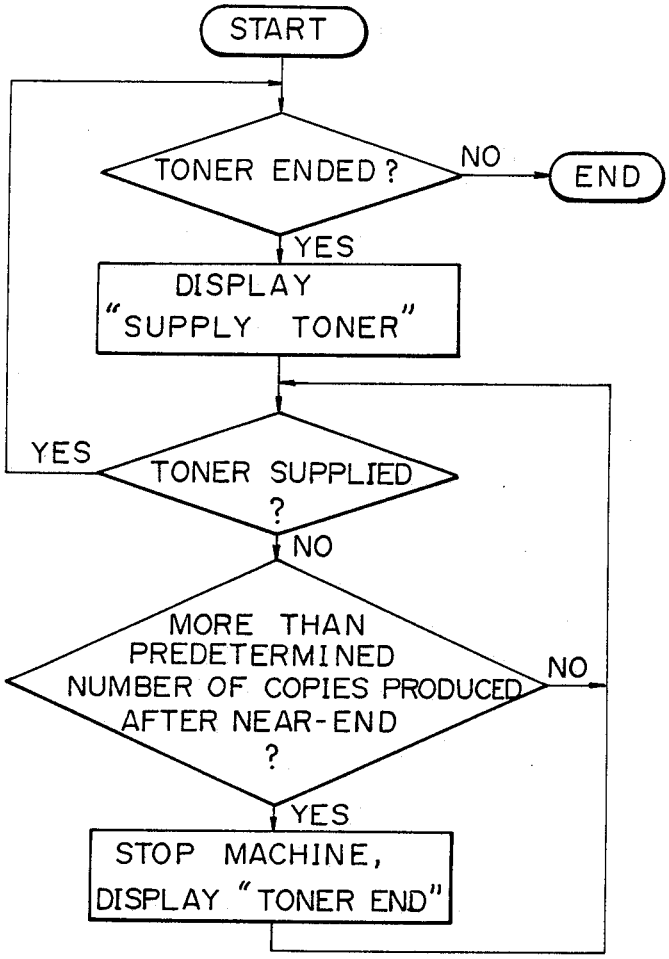
FIG. 10 is a flowchart demonstrating a specific operation of the copier associated with a toner near-end condition and toner supply.

FIG. 10 shows a sequence of steps associated with the previously discussed toner end and the supply of toner while FIG. 11 schematically shows a control system built in the copier 10. As shown in FIG. 10, after a toner-end condition has been sensed, a predetermined number of further copies can be produced with the remaining toner. This allows the toner cartridges 72 to be replaced to supply toner without interrupting the operation of the copier 10.

The embodiment of the present invention has been shown and described in relation to a developing unit of the type supplying toner into the developer container 50 from the toner supply chamber 56, mounting the toner cartridge 72 in the hopper 54 to introduce the toner into the supply chamber 56, and causing the agitating member 90 to agitate the toner in the supply chamber 56. It will be apparent, however, that the illustrative embodiment is similarly applicable to any other type of developing unit such as a developing unit in which the toner cartridge 72 is directly mounted in the developer container 50 so that toner introduced into the container 50 is agitated by an agitating member within the container 50. The developer stored in the developer container 50 may of course by implemented by a one-component developer, as stated earlier.

While the the disposable supply has been assumed to be a toner cartridge, the illustrative embodiment is applicable even to an image forming apparatus with which another kind of supply is used, as described hereinafter.

Figure 12:
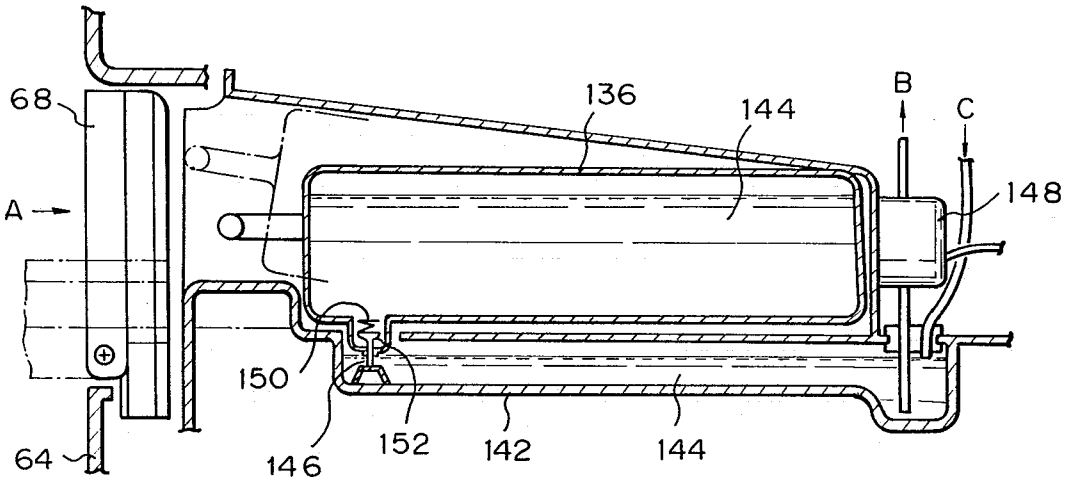
FIG. 12 is a section showing an alternative embodiment of the present invention.
Figure 13:
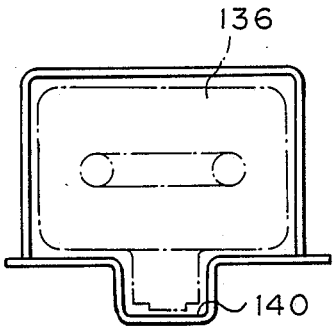
FIG. 13 is a schematic view of the copier as seen in a direction indicated by an arrow A in FIG. 12.
Figure 14:
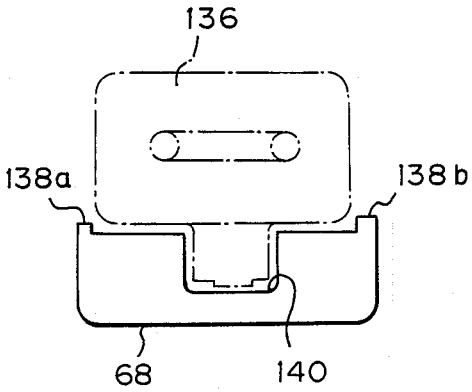
FIG. 14 is view similar to FIG. 13, showing the lid in an open position.

Referring to FIGS. 12 to 14, an alternative embodiment of the present invention is shown which uses a silicone oil tank 136 which is filled with silicon oil to be applied to a fixing roller of the fixing unit 40. The lid 68 is so located as to face the tank 136 an openably mounted on the front door 64. The lid 68 is provided with a pair of parallel elongate lugs 138*a* and 138*b* for guiding the tank 136 when the tank 136 is mounted and dismounted, and a channel 140 at the intermediate between the lugs 138*a* and 138*b*. The front door 64 is provided at its inner surface a lug which forms a part of an interlocking device as in the previous embodiment In the above construction, as the level of silicon oil 144 stored in an oil sump 142 of the tank 136 is lowered, silicone oil 144 is supplied from the tank 136 through an outlet 146 of the tank 136 so that the liquid level in the sump 142 is maintained constant. The oil 144 is fed by a pump 148 to the fixing unit 40 (FIG. 1) as indicated by an arrow B in FIG. 12 and thereby applied to the fixing roller. An excessive part of the oil 144 overflows and is returned to the oil sump 142 as indicated by an arrow C. When the liquid level in the oil sump 142 is lowered beyond a predetermined level, a message for urging the operator to replace the tank 136 appears on the display panel 62 (FIG. 3). Then, the operator opens the lid 68, removes the empty tank 136 while inclining it as indicated by a dash-and-dot line in FIG. 12, inserts a new tank along the guides 138*a* and 138*b* and channel 140 of the lid 68, and closes the lid 68 again. As the tank 136 is raised away from the bottom of the oil sump 142, a valve member 152 is urged downward by a spring 150 to close the outlet 146 thereby prevent the oil from flowing out.

As described above, the alternative embodiment allows the silicone oil tank 136 to be replaced by using the lid 68, i.e., without opening the front door 64 and therefore without causing the interlock switch to operate which would otherwise interrupt the copying operation. This promotes efficient production of copies. Since the lid 68 is associated with the front door 64 as in the first embodiment, the tank 136 may of course be replaced by opening the front door 64 as desired. It will be clear that any of the various constructions and arrangements shown and described in relation to the first embodiment may be applied to the alternative embodiment as needed.

In summary, the present invention has various advantages as enumerated below.

(1) A disposible supply can be replaced without opening a front door of an image forming apparatus and therefore without interrupting the operatin of the apparatus, whereby images are formed with high productivity. A person to replace the supply is prevented from being perplexed because the front door which conceals various mechanical and electrical parts and elements does not have to be opened.

(2) A supply can be replaced by opening the front door as desired because an openable lid is mounted on the front door.

(3) Even when the operator inadverstently puts the hand in a path for mounting and dismounting a developer cartridge, safety is insured. This allows a developer to be supplied without interrupting the operation of the apparatus.

(4) In the event of replacement of a developer cartridge, a developer is prevented from being scattered around from the members adapted to guide the cartridge to the outside of the apparatus.

(5) The developer can be dropped into a developer container with unprecedented efficiency.

Various modifications will become possible for those skilled in the art after receiving the teachings of the present disclosure without departing from the scope thereof.

What is claimed is:

1. An image forming apparatus having an image carrier, comprising:

a developing unit for developing an electrotatic latent image formed an said image carrier by a developer;

agitating means for agitating the developer which is stored in said developer unit;

a developer cartridge for supplying the developer to said developing unit in a predetermined developer supply position which is defined in a body of said apparatus;

an opening formed through a housing portion of said body of said apparatus for inserting and removing said developer cartridge from the developer supply position; and cartridge sensing mean for determining if said developer cartridge is loaded in the developer supply position in a condition which allows said apparatus to perform an image forming operation and, if said developer cartridge is not loaded, disenabling said agitating means.

2. An image forming apparatus having an image carrier, comprising:

a developing unit for developing an electrostatic latent image formed on said image carrier with a developer;

a developer cartridge for supplying a developer to said developing unit;

an opening formed through a housing portion of a body of said apparatus for inserting and removing said developer cartridge from a predetermined developer supply position which is defined in said body;

an openable lid swingably mounted on said housing portion for covering and uncovering said opening and, in an open position, guiding said developer cartridge toward and away from said developeer supply position;

a guide member becoming flush with said lid while being separated by a spacing from a base end of said lid, when said lid is held in the open position; and a developer collector for collecting the developer which is moved along said guide member to drop through said spacing when said developer cartridge is inserted and removed.

3. An apparatus as claimed in claim 2, further comprising a door which forms a part of said housing portion.

4. An apparatus as claimed in claim 3, wherein said door is provided with said developer collector and said lid.

5. An image forming apparatus comprising:

a body having a housing portion;

an opening formed through said housing portion for inserting and removing a supply unit in said body via a path and for retaining said unit in said body for operational purposes;

an openable lid associated with said opening for covering and uncovering said opening;

a door mounted on said housing portion of said body of said apparatus wherein said door is provided with said opening and said lid, whereby the image forming operation of said apparatus is interrupted when said door is opened; whereby an image forming operation of said apparatus is not interrupted even when said lid is open to uncover said opening.

* * * * *

UNITED STATES PATENT AND TRADEMARK OFFICE

CERTIFICATE OF CORRECTION

PATENT NO. : 4,967,234

DATED : October 30, 1990

INVENTOR(S) : TATSUO TANI ET AL.

It is certified that error appears in the above-identified patent and that said Letters Patent is hereby corrected as shown below:

On the title page:

The priority data has been omitted, please insert,

--Nov. 10, 1987 [JP] Japan . . . . 62-283624

Nov. 11, 1987 [JP] Japan . . . . 62-283000

Feb. 10, 1988 [JU] Japan . . . . 63-16440

Sept. 19, 1988 [JP] Japan . . . . 63-234184--.

Signed and Sealed this

Twenty-second Day of September, 1992

*Attest:*

DOUGLAS B. COMER

*Attesting Officer*

*Acting Commissioner of Patents and Trademarks*